US008397822B2

(12) United States Patent
Tetzlaff et al.

(10) Patent No.: US 8,397,822 B2
(45) Date of Patent: Mar. 19, 2013

(54) MULTIPHASE CONDUCTOR SHOE FOR USE WITH ELECTRICAL SUBMERSIBLE PUMP

(75) Inventors: Steven K. Tetzlaff, Owasso, OK (US); Kevin R. Bierig, Tulsa, OK (US); Joseph Scott Thompson, Owasso, OK (US)

(73) Assignee: Baker Hughes Incorporated, Houston, TX (US)

( * ) Notice: Subject to any disclaimer, the term of this patent is extended or adjusted under 35 U.S.C. 154(b) by 497 days.

(21) Appl. No.: 12/692,342

(22) Filed: Jan. 22, 2010

(65) Prior Publication Data

US 2010/0243264 A1 Sep. 30, 2010

Related U.S. Application Data

(63) Continuation-in-part of application No. 12/413,243, filed on Mar. 27, 2009, now abandoned.

(51) Int. Cl.
*E21B 43/00* (2006.01)
*E21B 4/04* (2006.01)

(52) U.S. Cl. ..... 166/369; 166/66.4; 166/370

(58) Field of Classification Search ..... 166/369, 166/370, 378, 62, 65.1, 66.4, 68, 104, 105; 417/410.1, 422, 424.1; 439/190, 191
See application file for complete search history.

(56) References Cited

U.S. PATENT DOCUMENTS

| | | | |
|---|---|---|---|
| 3,939,705 | A | 2/1976 | Glotin et al. |
| 4,391,330 | A | 7/1983 | Kiefer |
| 4,589,492 | A | 5/1986 | Greiner et al. |
| 4,767,349 | A | 8/1988 | Pottier et al. |
| 4,921,438 | A | 5/1990 | Godfrey |
| 5,740,860 | A | 4/1998 | Crawford et al. |
| 5,984,568 | A | 11/1999 | Lohbeck |
| 6,179,585 | B1 | 1/2001 | Kobylinski et al. |
| 6,298,917 | B1 | 10/2001 | Kobylinski et al. |
| 6,415,869 | B1 | 7/2002 | Smith |
| 6,682,309 | B2 | 1/2004 | Reid |
| 6,695,052 | B2 | 2/2004 | Branstetter et al. |
| 6,702,027 | B2 | 3/2004 | Olson et al. |
| 6,780,037 | B1 | 8/2004 | Parmeter et al. |

(Continued)

FOREIGN PATENT DOCUMENTS

| | | |
|---|---|---|
| EP | 0470576 A1 | 2/1992 |
| EP | 0745176 B1 | 4/1998 |

(Continued)

OTHER PUBLICATIONS

International Search Report and Written Opinion issued Sep. 20, 2012 for related PCT Application PCT/GB2011/000398.

*Primary Examiner* — Thomas Beach
*Assistant Examiner* — James Sayre
(74) *Attorney, Agent, or Firm* — Bracewell & Giuliani LLP

(57) ABSTRACT

A system for producing wellbore fluids. The system includes a pumping system deployable into tubing disposed in a wellbore, the pumping system includes a pump, a pump motor, a reservoir for containing purging fluid, and conductors in electrical communication with the pump motor. Electrical supply contacts are provided in the tubing and are connected to a downhole electrical power supply via a power cable extending along the tubing length from the surface. The conductors are engageable with the electrical supply contacts when the pumping system is landed within the tubing. Purging fluid in the reservoir can be flowed between the conductors and the supply contacts to remove conductive fluid prior to engaging the conductors and supply contacts. The conductors are selectively extended from a retracted position in the pumping system. In an alternative embodiment, the electrical supply contacts are provided at locations along the length of the tubing.

24 Claims, 11 Drawing Sheets

U.S. PATENT DOCUMENTS

| | | | | |
|---|---|---|---|---|
| 7,814,969 | B2 * | 10/2010 | Shaw | 166/65.1 |
| 8,056,619 | B2 * | 11/2011 | Patel et al. | 166/65.1 |
| 2002/0050361 | A1 | 5/2002 | Shaw et al. | |
| 2003/0085815 | A1 | 5/2003 | Tilton et al. | |
| 2003/0211768 | A1 | 11/2003 | Cameron | |
| 2005/0079075 | A1 | 4/2005 | Dolson | |
| 2006/0243450 | A1 * | 11/2006 | Head | 166/369 |
| 2009/0045146 | A1 * | 2/2009 | Stoesz | 210/767 |
| 2009/0242212 | A1 | 10/2009 | Shaw | |
| 2010/0243263 | A1 | 9/2010 | Tetzlaff et al. | |
| 2011/0180272 | A1 * | 7/2011 | Head | 166/378 |

FOREIGN PATENT DOCUMENTS

| | | | |
|---|---|---|---|
| WO | 98/22692 | A1 | 5/1998 |
| WO | 2005/003506 | A2 | 1/2005 |
| WO | 2005/038190 | A1 | 4/2005 |
| WO | 2007/023250 | A1 | 3/2007 |

* cited by examiner

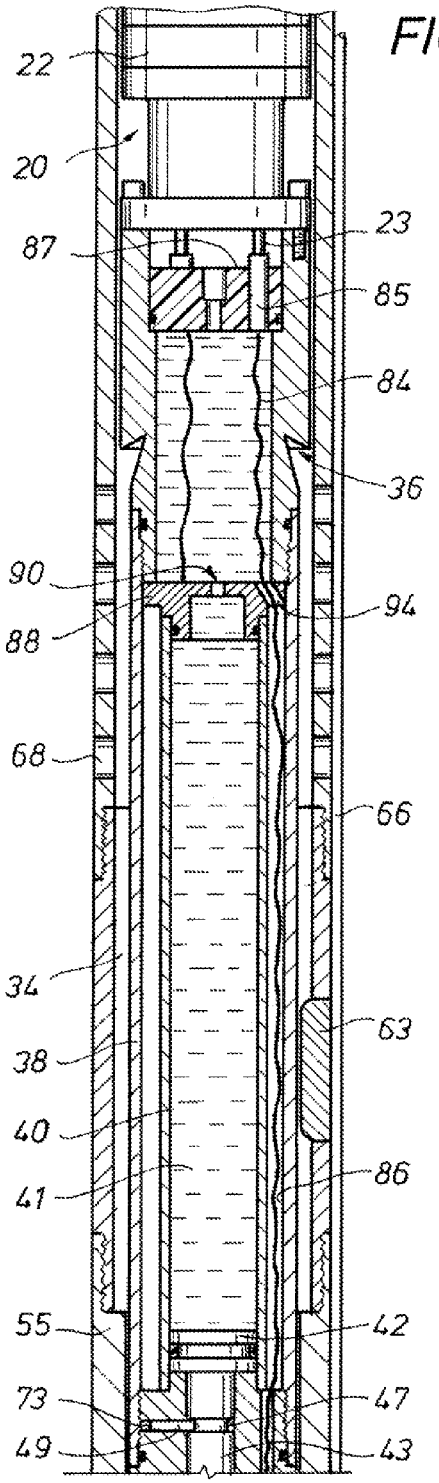
FIG.9A
FIG.9B
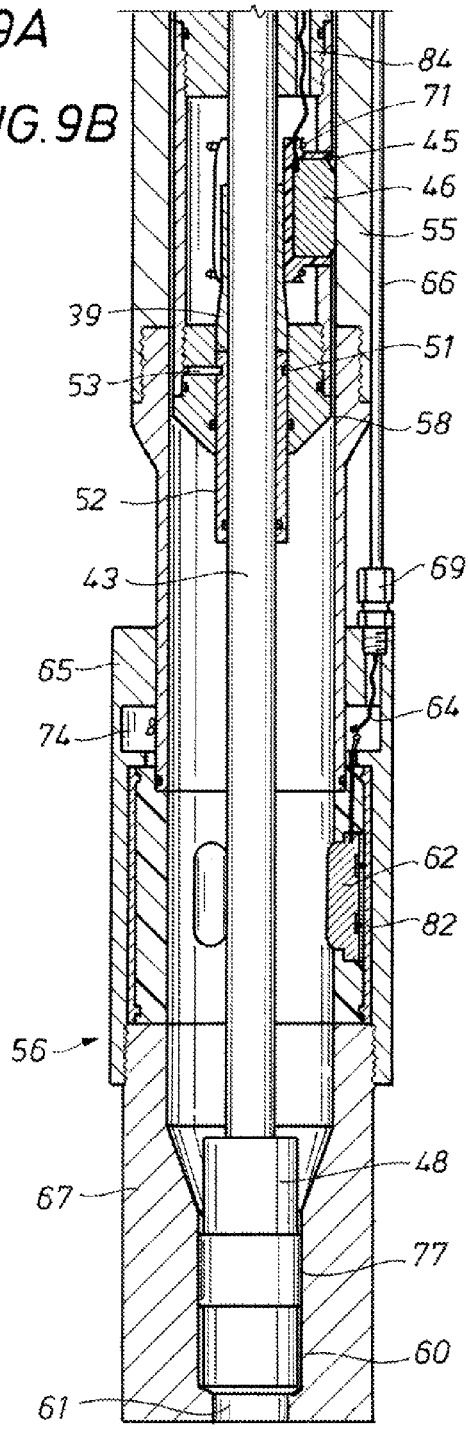

22
66
68
55
63
11
11
36
90
94
42
84
47

43
84
66
69
65
64
56
41
93
80
62
12
12
39
46
82
95
79
94
48
77

MULTIPHASE CONDUCTOR SHOE FOR USE WITH ELECTRICAL SUBMERSIBLE PUMP

CROSS-REFERENCE TO RELATED APPLICATIONS

The present application is a continuation in part of U.S. patent application Ser. No. 12/413,243 filed on Mar. 27, 2009, the entire specification of which being herein incorporated by reference.

BACKGROUND

1. Field of Invention

The present disclosure relates to downhole pumping systems submersible in well bore fluids. More specifically, the present disclosure concerns lowering a submersible pump system through tubing and connecting it electrically to an electrical receptacle mounted in the tubing.

2. Description of Prior Art

Submersible pumping systems are often used in hydrocarbon producing wells for pumping fluids from within the wellbore to the surface. These fluids are generally liquids and include produced liquid hydrocarbon as well as water. One type of system used in this application employs an electrical submersible pump (ESP), where the ESP is typically disposed at the end of a length of production tubing and has an electrically powered motor. Often electrical power may be supplied to the pump motor via a power cable. Normally, the power cable is strapped to the tubing and lowered along with the pump and the tubing. Typically, the pumping unit is disposed within the well bore just above where perforations are made into a hydrocarbon producing zone. ESPs typically require periodic retrieval for scheduled maintenance or repair. This usually entails removing the tubing and the power cable, which is secured alongside the tubing. Pulling and re-running the tubing is time consuming and pulling and reusing the power cable creates mechanical wear and can sometimes damage the cable.

Lowering the pumping assembly inside the production tubing would avoid a need for pulling the tubing to retrieve the pump. Proposals have been made to run the power cable on the tubing exterior and the pump in the tubing. The pump stacks into engagement with electrical contacts provided on the power cable lower end.

SUMMARY OF INVENTION

The present disclosure includes a system for producing fluids from a hydrocarbon producing wellbore, the system comprises production tubing disposed within the wellbore, a pumping system having a pump with fluid inlets, and a pump motor mechanically coupled to the pump. The pumping system is deployable through the production tubing. Conductor shoes are provided at locations along the length of the production tubing and configured to matingly couple with the pumping system. Also included is an electrical power supply line connected to a power source that connects with or otherwise engages a conductor shoe. Half of a conductor set may be included with the pumping system, where the conductors selectively extend outward as the pumping system couples with the conductor shoe. Optionally, conductors may be provided with the production tubing and selectively extend inward. The deployable pumping system can further include a supply of non-conducting fluid for purging the space where electrical connections are made.

BRIEF DESCRIPTION OF DRAWINGS

Some of the features and benefits of the present invention having been stated, others will become apparent as the description proceeds when taken in conjunction with the accompanying drawings, in which:

FIGS. 9A and 9B are side partial sectional views of the assembly landing in the receptacle.

Figure 1:
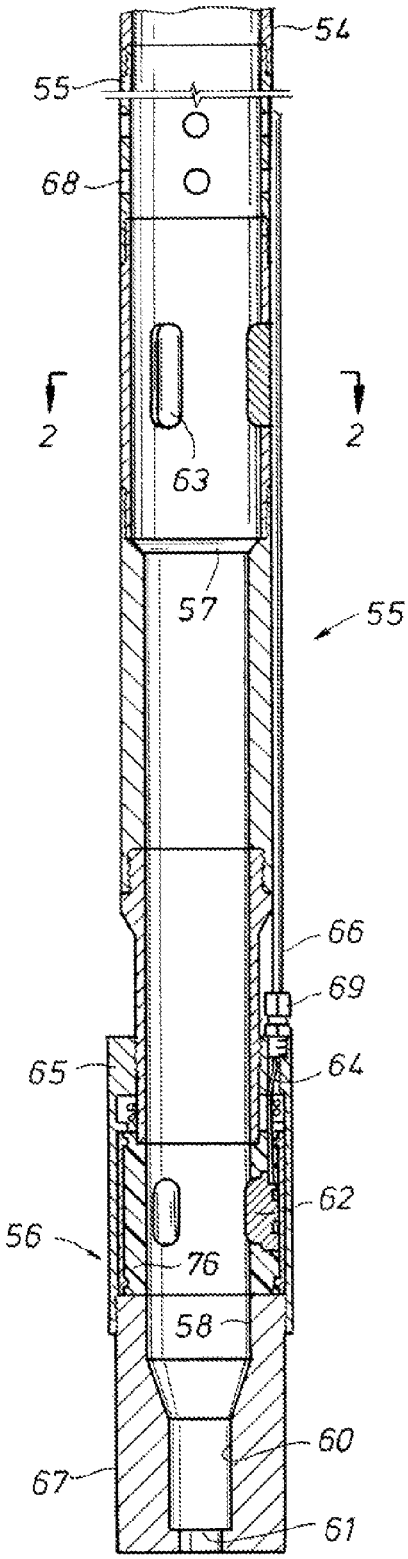
FIG. 1 is a side partial sectional view of a receptacle attached to production tubing.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different foul's and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

An example of an annular receptacle assembly 55 is shown in partial cross sectional view in FIG. 1 connected to the production tubing 54 lower end. Inlet passages 68 are shown formed through the receptacle assembly 55 near its upper end. Keys 63 are affixed to the receptacle assembly 55 inner circumference below the passages 68. The keys 63 as shown are elongate members that jut out into the assembly 55 annulus with their elongate side aligned with the assembly 55 axis. The receptacle assembly 55 inner diameter reduces at a transition 57 shown below the keys 63. A conductor assembly 56 (also referred to herein as a conductor shoe) is shown provided on the receptacle assembly 55 lower end. The examples of the conductor assembly 56 depicted includes an annular upper member 65 and a lower member 67. The upper member 65 upper end is coaxially affixed around the receptacle assembly 55 lower end. The upper member 65 lower end connects to the lower member 67.

An upper polished bore (PBR) 58 is shown formed within the upper member 65 annulus and extending into the lower member 67 inner surface. The upper PBR 58 transitions to a smaller diameter within the lower member 67, thereby defining a lower PBR 60. The upper and lower PBRs 58, 60 may be polished to provide sealing surfaces. Bore 61 coaxially extends downward from the lower PBR 60 through the lower member 67, the 61 is shown having a diameter less than the lower PBR 60 diameter.

Figure 3:
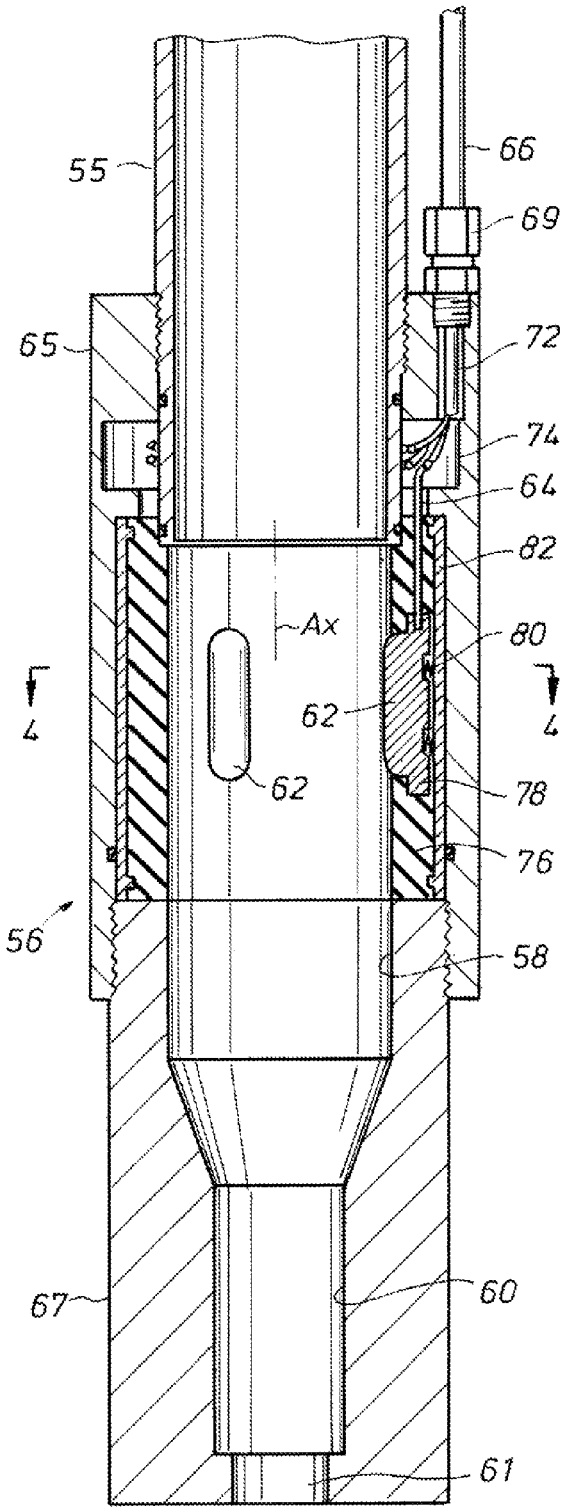
FIG. 3 is a detailed sectional view of a portion of the receptacle of FIG. 1.

An electrical cable 66 is provided adjacent the receptacle assembly 55. The lower end of the electrical power cable 66 terminates at a compression fitting 69 shown anchored onto the upper member 65. A detail is illustrated in FIG. 3 depicting an example of cable 66 connections to distribute power within the assembly 55. As shown, the cable 66 extends into a passage 72 formed in the upper member 65 and parallel to its axis. The passage 72 intersects an annular cavity 74 formed through the upper member 65 circumference. Supply leads 64 extend from the cable 66 into the cavity 74.

FIGS. 1 and 3 include an example of electrically distributing the power from the cable 66 within the receptacle assembly 55. Shown is an annular sleeve retainer 76 is coaxially provided within the upper member 65. The sleeve retainer 76 adjoins the lower member 67 and the upper PBR 58 extends onto the sleeve retainer 76 inner surface. The sleeve retainer 76 includes openings fanned around its circumference formed to receive electrical supply contacts 62 therethrough. The sides of the openings are shown generally aligned with the sleeve retainer 76 axis $A_X$. Each contact 62 includes a recessed lip 78 around its periphery that exceeds the respective openings' dimensions. When the contacts 62 are aligned coplanar with the openings, the lips 78 contact the openings' outer edge. While, as shown, the contact 62 can be restrained in place by the lip 78 and opening size difference, the contacts' 62 thicker midsection can extend radially inward past the contactor assembly 56 inner circumference. In the embodiment shown, the sleeve retainer 76 includes a recess around the opening edge that corresponds to the lip 72. Springs 80 are also shown providing a force urging the contact 62 towards the sleeve retainer 76 axis $A_X$. An insulator 82 may be provided between the sleeve retainer 76 and the upper member 65. The insulator 82 may be pliable and formed from a non-conducting material such as polyetheretherketone (PEEK). The insulator 82 can also be another non-conductive material in the thermoplastic family.

Figure 2:
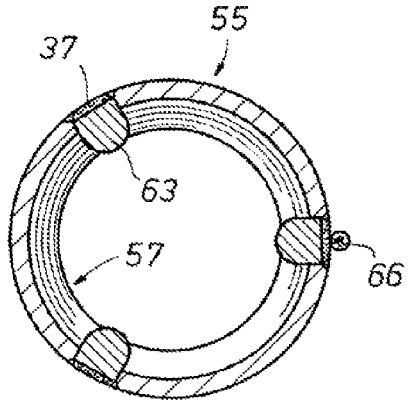
FIG. 2 is sectional view of the receptacle of FIG. 1.

FIG. 2 illustrates a sectional view of the receptacle assembly 55 of FIG. 1 taken along section line 2-2. Here three keys 63 are shown attached to the receptacle assembly 55 inner surface by welds 37 and spaced substantially equidistance apart. However the keys 63 can be affixed by any other suitable attachment means and are not limited to the spacing shown. Although three keys 63 are shown protruding into the bore in FIG. 2, other numbers of keys 63 could be included with the device shown herein.

Figure 4:
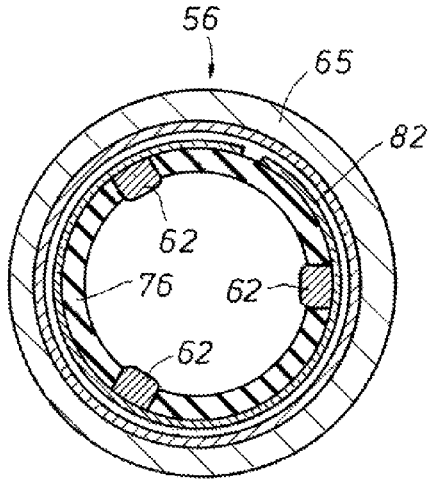
FIG. 4 is a sectional view of the receptacle of FIG. 3.

FIG. 4 illustrates a sectional view of the conductor assembly 56 of FIG. 3 taken along section line 4-4. Three supply contacts 62 are illustrated substantially equidistant from one another; the contacts 62 are not limited to this arrangement. Moreover, the contacts 62 could also be disposed at different elevations within the conductor assembly 56.

Figure 5A:
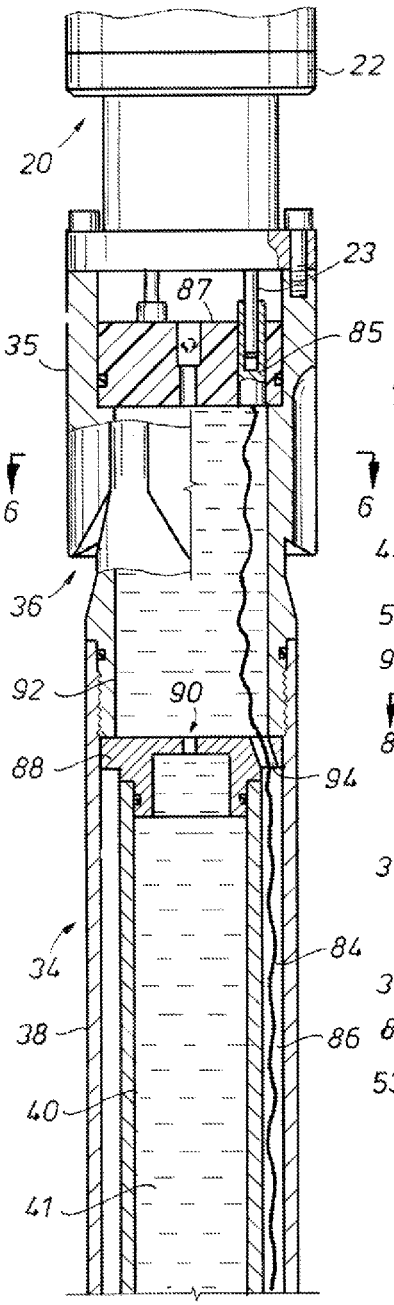
FIGS. 5A-5C are side section views of an assembly to be deployed in the production tubing and receptacle.
Figure 5B:
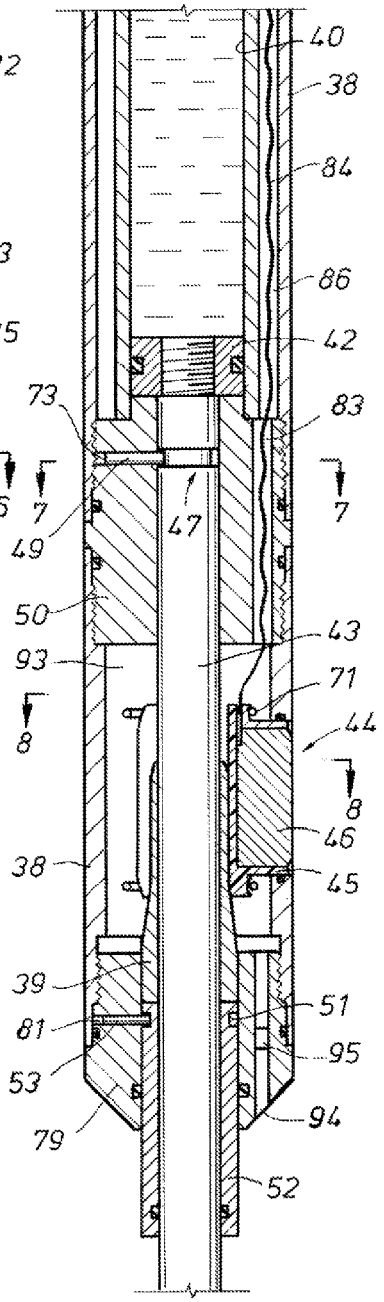
Figure 5C:
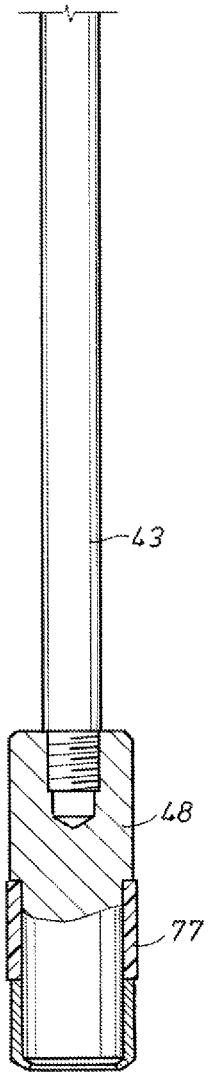
Figure 13:
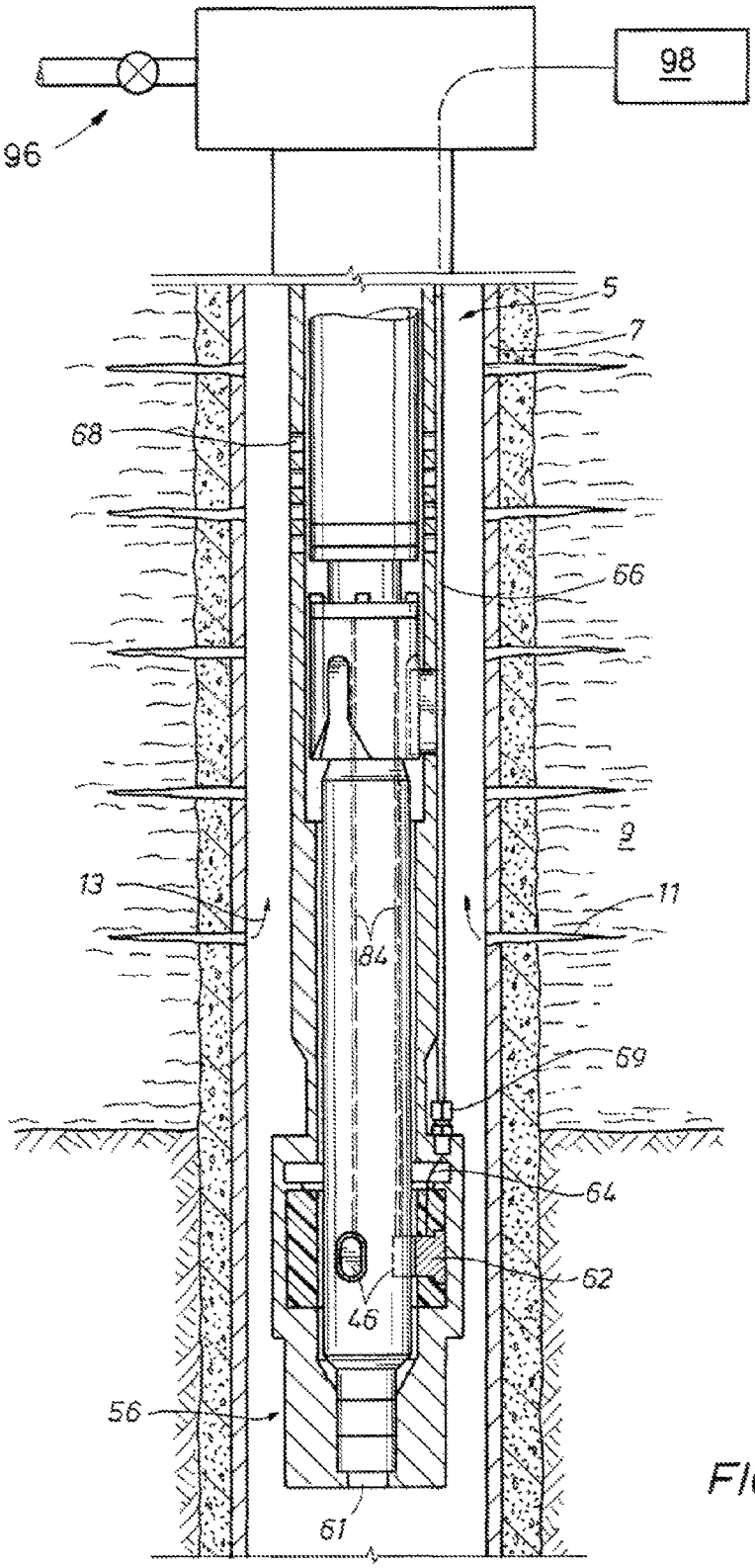
FIG. 13 is a side partial sectional view of the assembly fully coupled with the receptacle in a wellbore.

FIGS. 5A-5C illustrate a side partial sectional view of an example of a deployed assembly 34 attached to the bottom end of an electrical submersible pumping (ESP) system 20. The deployed assembly 34 described herein includes a volume of a purging fluid, a device or system to clean and/or purge an area using the purging fluid, and a device that couples with a tubing string. The purging fluid can be used for cleaning and purging an area free of unwanted fluid, and may be a non-conductive fluid, such as a dielectric oil suitable for the system and method disclosed herein. The purging fluid can be any media and can include non-conductive grease, non-conductive gel, solvents, or a combination of these alternatives. Shown in FIG. 5A is a generally cylindrically shaped conductor adapter head 35 provided on the deployed assembly 34 upper end. The adapter head 35 is shown bolted to the lower end of a motor 22 from the ESP system 20. Alternatively, the adapter head 35 could be integral with the ESP system 20. Electrical connectivity to the motor 22 is provided by a motor electrical receptacle 85 shown connected to a motor lead line 84. The receptacle 85 is anchored in an insulator block 87 within a cavity formed on the adapter head 35 upper end. An optional passage (not shown) can be included through the block 87 to allow for pressure equalization between the motor 22 and the deployed assembly 34, thereby also equalizing pressure in the fluid 41 to the pressure in the wellbore 5 (FIG. 13). A check valve may be included within the passage. A motor electrical connection pin 23 which extends from the motor 23 is shown inserted within the receptacle 85.

Figure 6:
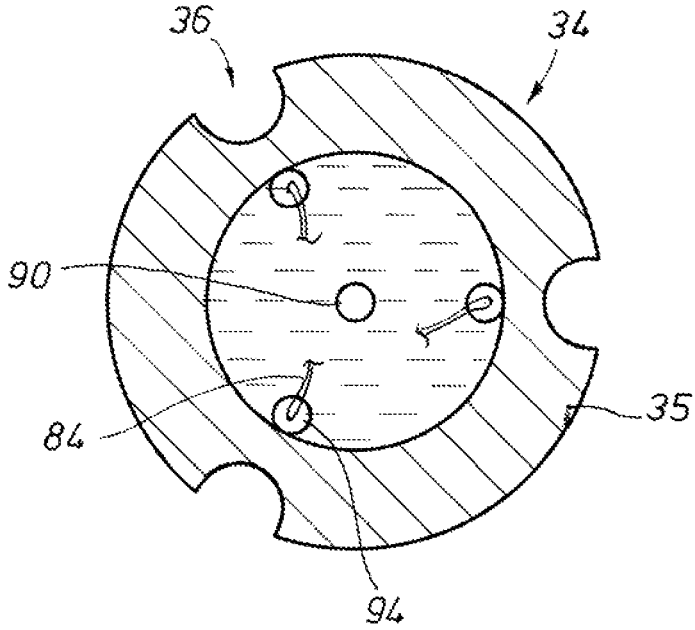
FIGS. 6-8 are sectional views of the embodiments of FIGS. 5A-5C.

The adapter head 35 includes profiled channels 36 on its outer surface shown having decreasing width from their respective openings to about the channels' 36 midpoint; upward from their midpoints, the channels' 36 width remains substantially constant. An upper reservoir 92 is housed within the adapter head 35 and shown filled with a purging fluid 41. Port 90 communicates the upper reservoir 92 with the reservoir 40. A sectional view of the adapter head 35 taken along section line 6-6 from FIG. 5A is provided in FIG. 6. This view depicts three profiled channels 36 in a section having a constant width. Also shown are the motor lead lines 84 exiting ports 94 fowled in a bulkhead 88 (FIG. 5A) provided at the adapter head 35 lower terminal end. The bulkhead 88 shown also includes an orifice 90 formed axially therethrough roughly at its midsection.

The adapter head 35 lower end coaxially attaches to a housing 38 covering the deployed assembly's 34 mid portion. A reservoir 40 is shown coaxially provided within the housing 38 coupled to the bulkhead 88 on its upper end. Purging fluid 41 is stored in the reservoir 40 communicatable to the upper reservoir 92 through the orifice 90. An annular space 86 is shown formed in the housing 38 wall and oriented generally parallel to the housing 38 axis. The annular space 86 registers with the port 94 at its upper end.

Referring now to FIG. 5B, the motor lead line 84 exits the annular space's 86 bottom end into, a passage 83 formed in a rod guide 50. The passage 83 upper end registers with the annular space 86 bottom and the passage 83 lower end terminates at the rod guide 50 bottom. The lead line 84 emerges from the passage 83 into an open space 93 in the housing 38 where it connects to a contact assembly 44. The rod guide 50 is a generally annular member shown coaxially affixed within the housing 38 and circumscribing the upper portion of a piston rod 43. A piston 42 on the rod 43 upper end is held in the lowermost portion of the reservoir 40. A bore 73 radially formed within the rod guide 50 registers with a groove 47 provided in the piston rod 43. A shear pin 49 inserted into the bore 73 extends into the groove 47, thereby maintaining the rod 43 and piston 42 in place as shown. The piston rod 43 lower end connects to a cylindrical plunger 48; a seal 77 is shown on the plunger 48 outer periphery (FIG. 5C) configured for sealing insertion into the lower PBR 60.

Figure 7:
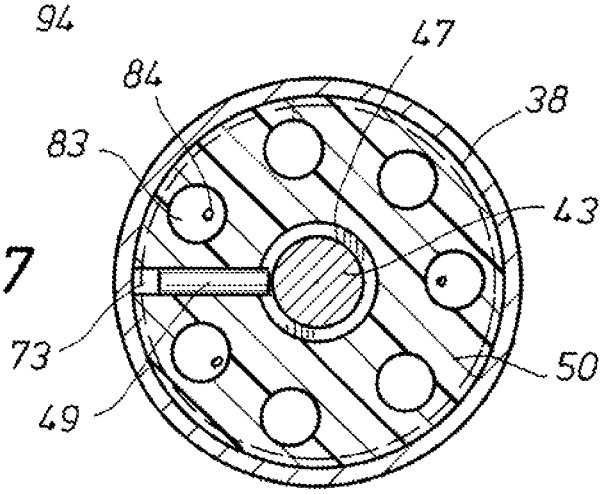

FIG. 7 illustrates a sectional view taken along line 7-7 from FIG. 5B. In this view multiple passages 83 are shown axially formed in the rod guide 50, some of which include motor lead lines 84. As will be discussed in more detail below, a fluid motive source can be included for urging the fluid 41 from the reservoir 40. Passages 83 provide a flow path for the purging fluid 41 from the annular spaces 86 to flow into the open space 93 below the rod guide 50. Referring back to FIG. 5B, the contact assembly 44 includes a conductor 46 connected to the motor lead line 84 and partially housed in an insulating boot 45. A tapered sleeve 39 is provided around the piston rod 43 where the boot 45 rests against the sleeve 39. The sleeve 39 cross section is frusto-conical, and thicker below its contact area with the insulating boot 45.

Figure 8:
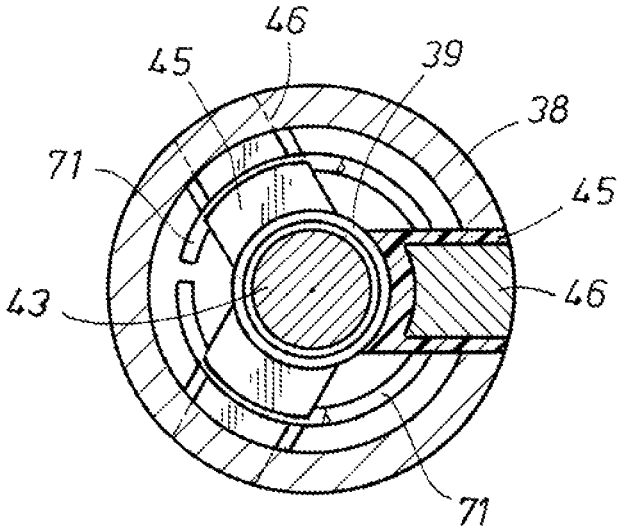

Openings provided in the housing 38 are shaped to allow the conductor 46 to protrude radially outward past the housing 38 outer surface. As shown, the conductor 46 is retained within the space 93 by retaining springs 71 that circumscribe the piston rod 43 at the upper and lower portions of the boot 45. FIG. 8 represents a sectional view taken at lines 8-8, which is at two different elevations on the housing 38. In FIG. 8, three contacts 46 with their respective insulating boots 45 are depicted; with one shown in a sectional view and the others in an overhead view spatially showing a retaining spring 71 coupling with the insulating boots 45. In one example, the retaining spring 71 can be a hemispherically shaped C-ring.

Referring back to FIG. 5B, further illustrated is an insulation base 79 attached to the housing 38 lower end; an opening is axially formed through the base 79 that circumscribes the tapered sleeve 39 lower end. A collar 52 is attached to the piston rod 43 just below the tapered sleeve 39; the collar 52 upper end also resides in the opening. A groove 51 circumscribing the sleeve 52 outer surface registers with a bore 81 radially formed in the insulation base 79. A shear pin 53 is inserted through the bore 81 and into the groove 51, thereby further retaining the piston rod 43 in place. A passage 94 is formed through the insulation base 79 between the open space 93 and the base 79 lower end. A check valve 95 disposed in the passage 94 permits single direction flow from the space 93.

FIGS. 9A and 9B illustrate in sectional view an embodiment of the deployed assembly 34 being landed in the receptacle assembly 55. As shown, the plunger 48 is inserted within the lower PBR 60, blocking flow through the bore 61. Further, the profiled channel 36 is above the key 63 and the conductor 46 is above the supply contact 62. Fully coupling the deployed assembly 34 within the receptacle assembly 55 involves mating the key 63 in the profiled channel 36 and providing electrical contact between the conductor 46 and the supply contacts 62. Moreover, the space around the supply contacts 62 should be washed free of debris and any electrically conducting fluids purged away. This may be accomplished by the purging fluid 41 supplied in the deployed assembly 34.

After the deployed assembly 34 is lowered and the plunger 48 is forced into the lower PBR 60, the ESP system 20 and deployed assembly 34 combined weight applies a force sufficient to fracture the shear pin 49, thus freeing the piston rod 43 and piston 42 to move with respect to the remaining components in the deployed assembly 34. More specifically, the deployed assembly 34 slides downward over the piston rod 43, which in turn pushes the piston 42 into the reservoir 40. The moving piston 42 in an example of a fluid motive source that forces purging fluid 41 from the reservoir 40, through the orifice 90 and port 94, and into the annular spaces 86. Continued upward piston 42 movement ultimately empties the fluid 41 from the reservoir 40 to fill and pressurize the open space 93 below the annular spaces' 86 exits. After the space 93 is filled with the purging fluid 41, the check valve 95 opens to allow flow through the passage 94 for purging wellbore fluid from the conductor assembly 56. The purging fluid 41 density exceeds wellbore fluid density, which forces the wellbore fluid upward from within the conductor assembly 56 in the space between the receptacle assembly 55 and the deployed assembly 34. As shown, the shear pin 53 is sheared while the deployed assembly 34 is reaching the final stage of landing within the receptacle assembly 55. This occurs as the plunger 48 contacts the collar 52, which forces the tapered sleeve 39 upward extending the combined boot 45 and conductor 46 outward engaging/making contact with supply contact 62 in the final stages of the landing process.

Optionally, the check valve 95 may be configured to open at a specific set pressure. The set pressure can be set based on wellbore fluid pressure, on the pressure in the space 93 when substantially filled with purging fluid 41, or another design criteria. Establishing a suitable set pressure is within the scope of those skilled in the art.

Figure 10A:
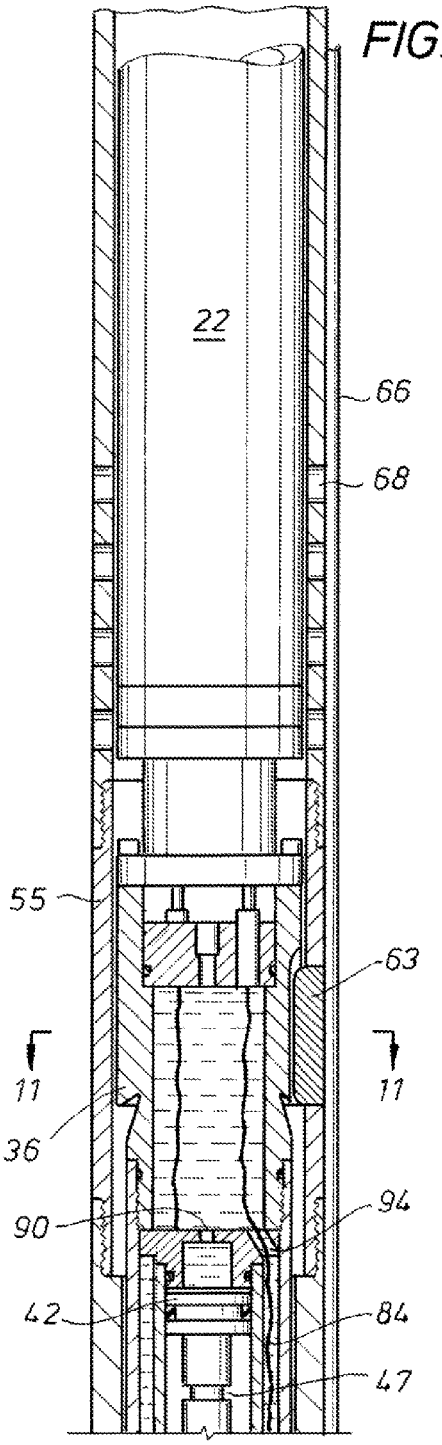
FIGS. 10A and 10B are side partial sectional views of the assembly landed in the receptacle.
Figure 10B:
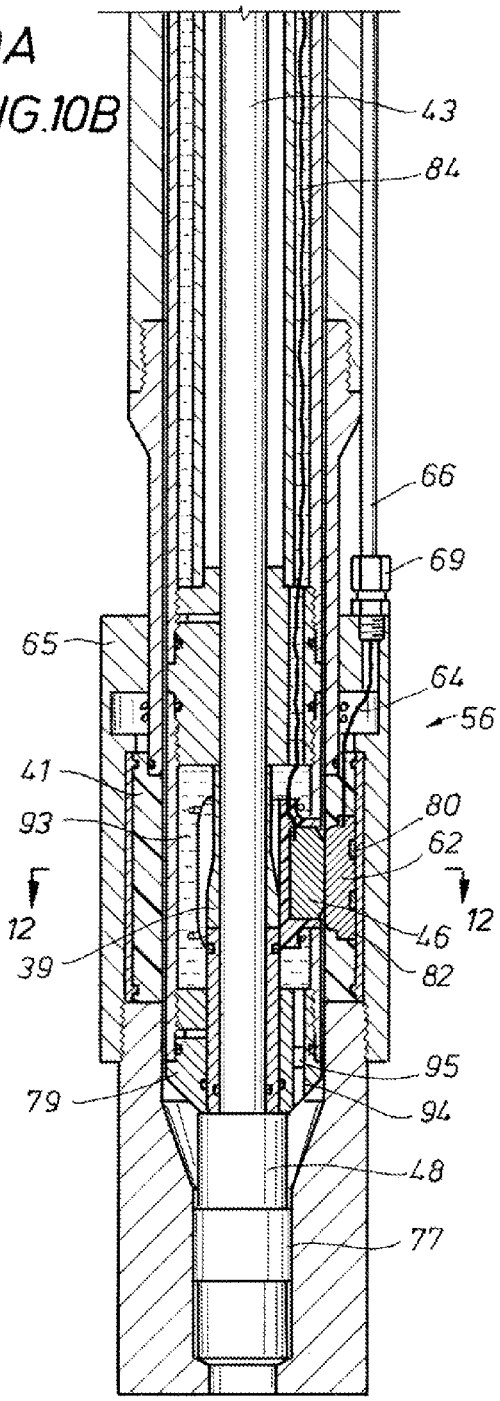

FIGS. 10A and 10B depict partial sectional views of the deployed assembly 34 fully landed in the receptacle assembly 55. In one example, a fully landed deployed assembly 34 has its weight supported by the receptacle assembly 55, including the weight of an associated ESP system 20. A fully landed deployed assembly 34 may also be engaged by the receptacle assembly 55 to prevent deployed assembly 34 rotation. A fully landed deployed assembly 34 may also be oriented in a pre-selected azimuth within the receptacle assembly 55, where a pre-selected azimuth aligns electrical contacts in the deployed assembly 34 with electrical contacts in the receptacle assembly 55.

Figure 11:
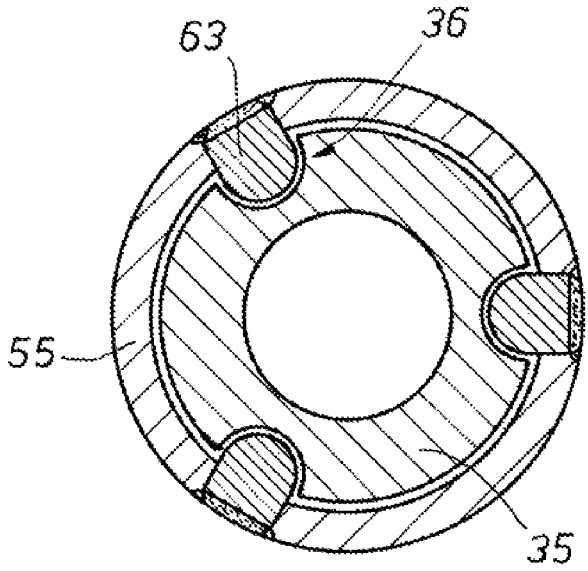
FIGS. 11 and 12 are sectional views respectively from FIGS. 10A and 10B.

FIGS. 10A and 10B provide an example of supporting the deployed assembly 34 within the receptacle assembly 55 by engaging the key 63 and the profiled channel 36. Alternatives exist having multiple channels 36. Preferably the opening or openings on the channels) 36 circumscribing the deployed assembly 34 are profiled with sufficient width so a key 63 is engaged with an opening irrespective of the assembly's 34 azimuthal orientation. After a channel 36 opening engages a key 63, the profiled channel 36 angled surface slides on the key's 63 upper surface, which rotates the deployed assembly 34. The channel 36 slides on the key 63 until the key 63 top is aligned with the constant width portion of the profiled channel 36. At this point, the deployed assembly 34 drops to insert the key(s) 63 into the constant width portion of the profiled channel 36. The key 63 and channel 36 coupling locks the deployed assembly 34 to prevent its rotation. FIG. 11 provides a sectional example taken along line 11-11 from FIG. 10A depicting key 63 and profiled channel 36 in full engagement. In this example, shown are three keys 63 with corresponding profiled channels 36, however the device presented herein is not limited to this number and can include fewer or more. Additionally, strategic key 63 and channel 36 placement provides a desired deployed assembly 34 orientation.

Figure 12:
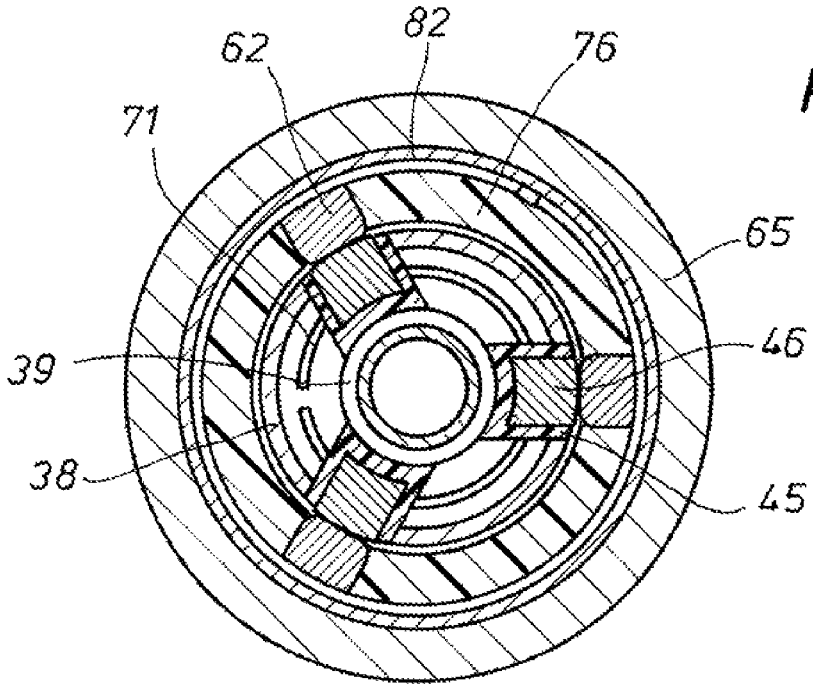

An example of electrically coupling the conductor 46 and supply contact 62 is illustrated in FIGS. 10A and 10B. Orienting the deployed assembly 34 can align the conductor 46 with the supply contact 62. As noted above, a portion of the supply contact 62 extends radially inward past the sleeve retainer 76. The conductor 46 is moved radially outward into electrical contact with the supply contact 62 by the tapered sleeve 39 being moved upward so its thicker portion is behind the insulated boot 45. Moving the piston rod 43 so the sleeve's 39 thicker portion is between the insulating boot 45 and the piston rod 43 radially pushes the conductor 46 outward into engaging contact with the supply contact 62. Electrically engaging the conductor 46 and the supply contact 62 provides a continuous path to flow electricity to the motor 22 from the power cable 66. FIG. 12 provides a sectional example taken along line 12-12 from FIG. 10B depicting conductor 46 and the supply contact 62 full engagement. In this example, shown are three conductors 46 with corresponding supply contacts 62, however the device presented herein can have other numbers of conductors 46 and contacts 62.

The seal 77 between the plunger 48 and the lower PBR 60 retains the purging fluid 41 in the space between the deployed assembly 34 and receptacle assembly 55. Retaining the purging fluid 41 in this space prevents the displaced fluid from returning to within the conductor assembly 56, thereby isolating the conductor 46 and supply contact 62 from electrolytic fluid interference or other contaminants. The sealing function between the plunger 48 and the lower PBR 60 can occur as soon as these members are coupled.

Referring now to FIG. 13, a side view example of the ESP system 20 and attached deployed assembly 34 is depicted fully landed within the receptacle assembly 55, which is illustrated in a partial sectional view. As noted above, fully landing the deployed assembly 34 within the receptacle assembly 55 anchors an associated ESP system 20 against rotation so it can be operational. Further, fully landing the deployed assembly 34 within receptacle assembly 55 provides electrical power for energizing the pump of the ESP system 20. FIG. 13 illustrates formation fluid 13 (illustrated by arrows) entering the well bore 5 from perforations 11 that extend into the formation 9 through the casing 7. The fluid 13 can be delivered for pumping to the pump 20 via the inlet passages 68 and then onto pump inlets (not shown). Optional exit passages above the pump may be included so vapor can escape from the tubing 54. The electrical cable 66 is illustrating having its upper end connected to an electrical power source 98, routed through a surface mounted wellhead assembly 96, and then into the wellbore 5.

Figure 14:
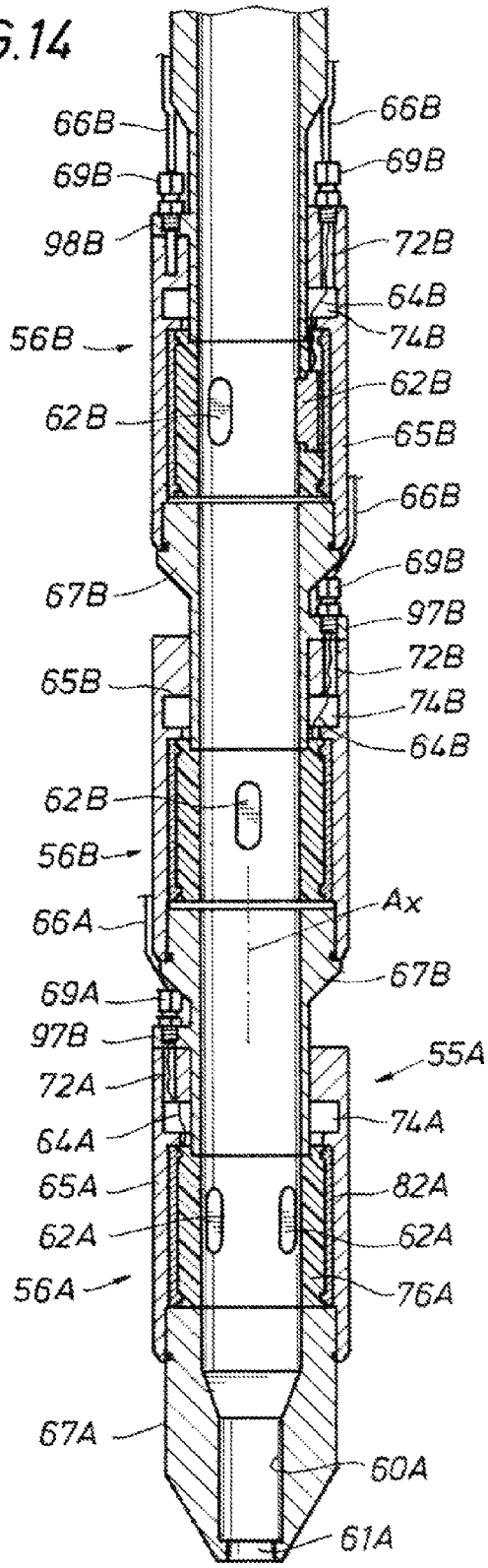
FIG. 14 is a side partial sectional view of an alternative example of the receptacle of FIG. 3.

An alternate embodiment of a receptacle string 55A is shown in a side partial sectional view in FIG. 14. Multiple conductor assemblies 56A, 56B are shown stacked on the receptacle string 55A of FIG. 14; the multiple conductor assemblies 56A, 56B provide redundant contact points in the event of a failure. The lower most conductor assembly 56A of FIG. 14 is similar to the conductor assembly 56 of FIG. 3; it includes a lower member 67A that is annular and substantially coaxial with receptacle string 55A. A bore 61A in the lower member 67A has a frusto-conically shaped portion, a reduced diameter proximate its lower terminal end, and a lower PBR 60A defined in the space between the frusto-conically shaped portion and the lower terminal end. The lower most conductor assembly 56A also includes an annular upper member 65A shown coaxially coupled to the lower member 67A. In the example of FIG. 14, the upper member 65A is attached to the upper terminal end of the lower member 67A by threads (not shown) correspondingly formed on the outer surface of the lower member 67A and inner wall of the upper member 65A.

An annular insulator 82A is shown on the inner wall of the upper member 65A just above the lower member 67A, the insulator 82A can be formed from PEEK or another insulating material. Coaxially circumscribed within the insulator 82A is a sleeve retainer 76A in which supply contacts 62A are embedded. Similar to the contacts 62 of FIG. 3, the supply contacts 62A are illustrated disposed about the circumference of the inner surface of the receptacle string 55A. Power to the supply contacts 62A can be supplied through attached power cables 66A. Although two supply contacts 62A are shown, the number of supply contacts 62A can equal the number of electrical phases provided within the cables 66A; thus embodiments exist where a single contact 62A is, or three or more supply contacts 62A are, provided within the conductor assembly 56A. Electrical leads 64A (one for each phase) extend from within the cable 66A to each of the supply contacts 62A and in a similar fashion to the electrical leads 64 illustrated in FIG. 3. An annular cavity 74A is formed in the upper member 65A shown projecting radially into the wall of the member 65A from its inner radius. The cavity 74A provides a gallery like path from which electrical leads 64A can drop down to each contact 62A along a path substantially parallel to the axis $A_X$ of the receptacle string 55A.

The conductor assemblies 56B of FIG. 14 shown above the lower most conductor assembly 56A each include an upper member 65B connected to a lower member 67B. The lower end of each upper member 65B includes threads (not shown) on its inner wall that engage threads (not shown) at the upper end of each lower members 67B on its outer surface. While the upper members 65B are similar to the upper member 65A of the lower most conductor assembly 56A, the lower members 67B are not. For example, the inner radius of each lower member 67B is substantially constant along their respective lengths, unlike the reduced inner radius of the lower member 67A. Additionally, the outer surface of each lower member 67B is profiled radially inward a distance spaced below their respective upper ends. The wall thickness of each lower member 67B remains substantially constant in the region between the profiled section and its lower terminal end.

The lower members 97B also are each shown having a support ridge 97B on their outer surface in a region between the profiled section and lower terminal end. The support ridges 97B circumscribe a portion of the lower member 67B outer surface and are shown having upper and lower surfaces generally perpendicular to the axis $A_X$ of the receptacle string 55A. The lower surfaces of the support ridges 97B rest on the respective upper terminal surfaces of upper members 65A, 65B of adjacent conductor assemblies 56A, 56B. Passages 72A, 72B that are substantially parallel to the axis $A_X$ of the receptacle string 55A, are shown fowled through the support ridges 97B and into the adjacent upper members 65A, 65B. Compression fittings 69A, 69B are shown coupled into the opening of the passages 72A, 72B for securing the terminal end of the power cable 66A, 66B to the receptacle string 55A. The electrical leads 64A, 64B travel through the passages 72A, 72B onto the cavities 74A, 74B.

Figure 15:
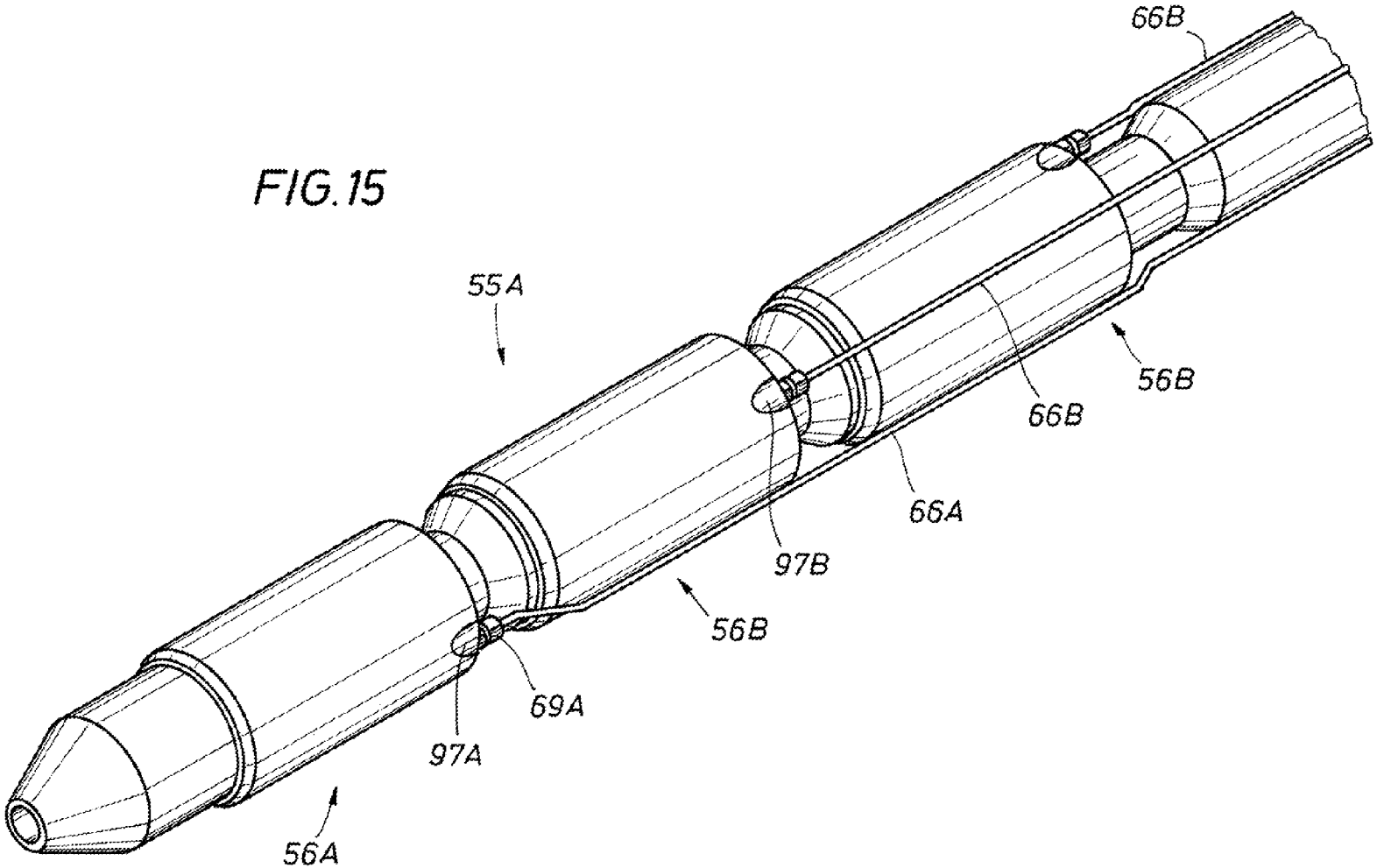
FIG. 15 is a perspective view of the receptacle of FIG. 14.

The conductor assemblies 56A, 56B are shown optionally rotated with respect to one another. The power cables 66A, 66B connected to these assemblies 56A, 56B thus can also be staggered at spaced apart locations around the circumference of the receptacle string 55A. A perspective view of the receptacle string 55A is provided in FIG. 15 illustrating lateral separation between the cables 66A, 66B as they extend along the length of the receptacle string 55A. In an example of use, a deployed assembly 34 may be inserted within the receptacle string 55A and in electrical communication with one of the conductor assemblies 56A, 56B. If one of the conductor assemblies 56A, 56B fails, the deployed assembly 34 may continue operating by being repositioned within the receptacle string 55A and into electrical communication with a still operating conductor assembly 56A, 56B. Thus the redundant conductor assemblies 56A, 56B provide corrective action to electrical supply failure that does not require disassembly and removal of the electrical cables 66A, 66B or receptacle string 55A.

Figure 16:
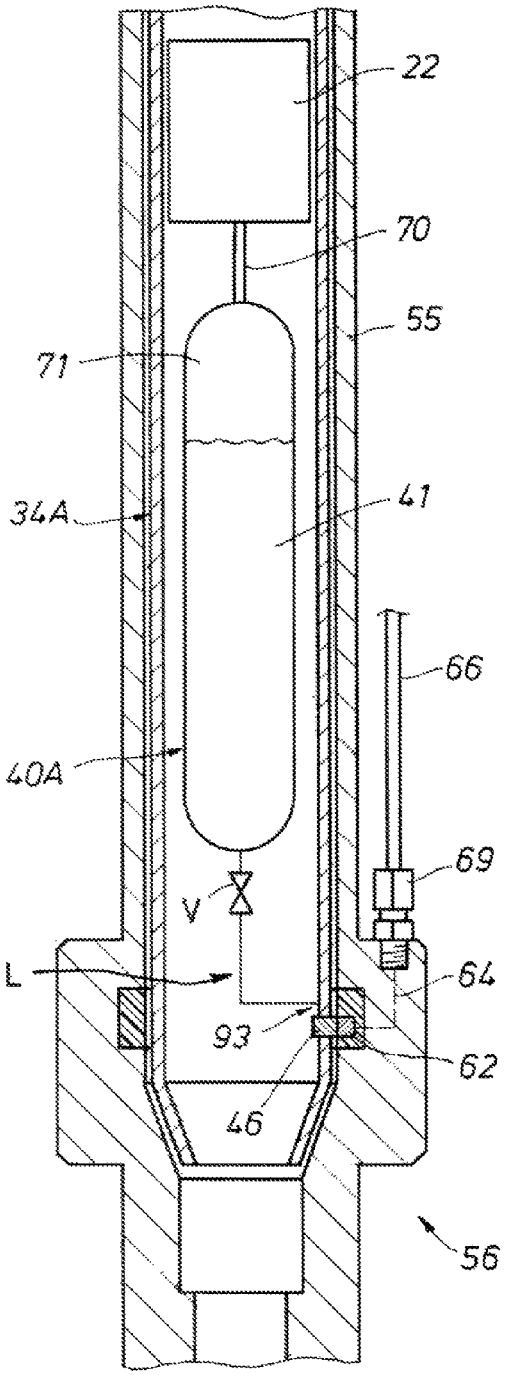

An alternative example of a deployed assembly 34A is shown in a partial sectional schematic view in FIG. 16, where it is coaxially disposed within a receptacle string 55. In this embodiment the reservoir 40A is pressurized prior to being deployed downhole. A discharge line 72 connects between the reservoir 40A and the open space 93. A valve 74 illustrated in the discharge line 72 regulates flow through the discharge line 72; and when open allows the fluid 41 to flow from the reservoir 41, through the discharge line 72, and into the space 93. The valve 74 can be any device for selectively allowing fluid communication, such as a gate valve, ball valve, globe valve, slide valve, a rupture disk, or combinations thereof. The valve 74 can be motor operated or coupled to a linkage. The valve actuation mechanism, whether by motor or by linkage, can be activated so that the fluid 41 is discharged from the reservoir 40 at a time and location similar to that described with regard to FIGS. 10A and 10B.

An alternative example of a fluid motive source is an expandable fluid 71, such as nitrogen, air, argon, and the like. The expandable fluid 71 can be added to the reservoir 40A with the fluid 41 and compressed to maintain a positive pressure within the reservoir 40A. Pressure equalization between the reservoir 40A and wellbore can take place via an equalization line 70 shown coupled between the reservoir 40A and motor 22. As the fluid 41 empties from the reservoir 40A through the open valve 74, the expandable fluid 71 expands to fill the void left by the escaping fluid 41 thereby maintaining a force to urge the fluid 41 into the space 93.

Figure 17:
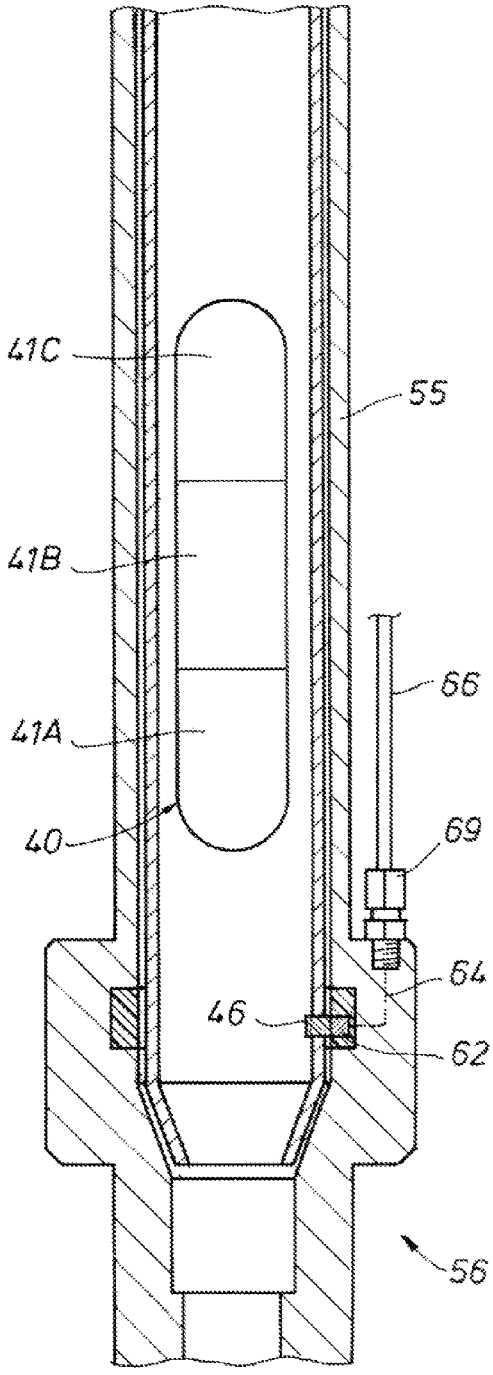

In FIG. 17, the deployed assembly 34 is illustrated within the receptacle 55 and having more than one type of fluid in the reservoir 40. In this example, three types of fluids 41A, 41B, 41C, each having a different density, are stored within the reservoir. Although three fluids 41A, 41B, 41C are illustrated, embodiments exist having two fluids or more than three fluids. The fluids 41A, 41B, 41C stratify so that the most dense fluid, which in this example is fluid 41A, settles within the bottom portion of the reservoir 40. The second most dense fluid 41B resides above fluid 41A and below fluid 41C. In this example, the fluids 41A, 41B, 41C can be directed from the reservoir 40 in a sequence based on the density of each of the fluids 41A, 41B, 41C. For example, storing the fluids 41A, 41B, 41C within the system of FIGS. 9A and 9B, would first direct the lowest density fluid 41C from the reservoir 40, then the denser fluids in order of increasing density. In one example of use, the less dense fluid(s) can be discharged first and include a solvent that is directed from the reservoir 40 to the space 93 for cleaning one or all of the supply contacts 62, the conductors 46, and area around these elements. The denser fluid can be a dielectric fluid for insulating the space 93 and other areas adjacent the supply contacts 62 and conductors 46.

Figure 18:
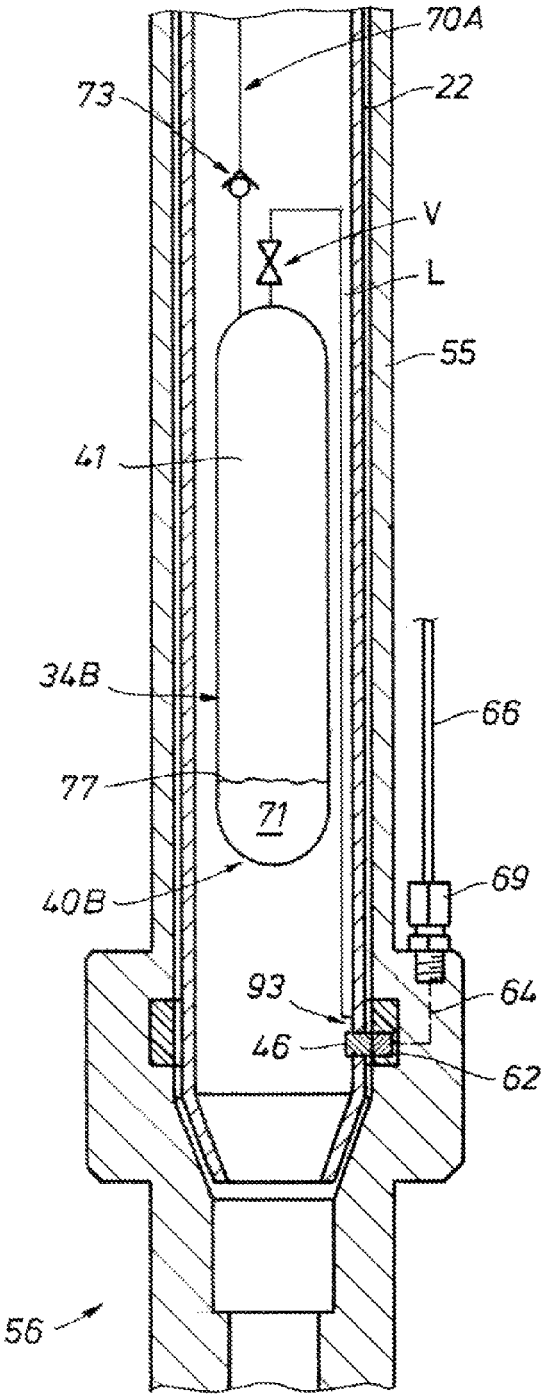
FIGS. 16-18 are side partial sectional views of alternate embodiments of the assembly landing in the receptacle.

Referring now to FIG. 18, an example of a deployed assembly 34B is shown in a partial side schematic view and deployed within a receptacle string 55. Similar to the deployed assembly 34A of FIG. 16, the deployed assembly 34B of FIG. 18 also includes an expandable fluid 71 within a reservoir 40B that is used as a fluid motive source. The expandable fluid 71 of FIG. 18 is disposed at the lower portion of the reservoir 40B and within a bladder 77 to maintain the expandable fluid 71 at the lower portion. A discharge line 72A, with inline valve 74A, has an end connected to the upper portion of the reservoir 40B and an opposite end disposed to discharge proximate the space 93. An equalizing line 70A allows pressure communication between the reservoir 40B and motor 22, a check valve 73 in the equalization line 73 may be included to prevent any backflow from the reservoir to the motor 22. The operation of the embodiment of FIG. 18 is much the same as that described in FIG. 16, except the fluid 41 exits the upper portion of the reservoir 40B rather than the lower portion. In this example, the fluid 41 can include or be made up of more than one fluid, such as described in FIG. 17, so that a lower density fluid would be first discharged from the reservoir 40B.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, a supply of purging fluid or media could be pressurized and sealed in a vessel that is selectively opened to discharge the purging fluid. Selectively opening could include opening a valve or rupturing the vessel. Optionally, each ESP system 20 components can be installed in separate downhole deployments. For example, the motor, seal section, intake, and pump could be deployed individually, or in combination, to allow flexibility of the system string installation. These and other similar modifications will readily suggest themselves to those skilled in the art, and are intended to be encompassed within the spirit of the present invention disclosed herein and the scope of the appended claims.

The invention claimed is:

1. A system for producing fluids from a hydrocarbon producing wellbore comprising:

a receptacle adapted to be mounted to a lower portion of a string of tubing;

receptacle contacts in the receptacle that are adapted to be in electrical communication with an electrical power source; and a pumping system deployable through the tubing and into engagement with the receptacle, comprising:

a pump with fluid inlets;

a pump motor in mechanical communication with the pump;

electrical motor contacts in electrical communication with the motor and that are selectively moveable from a retracted position to an extended position and into selective electrical communication with the receptacle contacts so that the pump motor is energizable by the electrical power source; and a purging system deployable with the pumping system through the tubing, the purging system containing flowable material, so that when the pumping system lands within the receptacle, the flowable material discharges from the purging system to between the motor contacts and the receptacle contacts.

2. The system of claim 1, further comprising a retaining member circumscribing the motor contacts, the retaining member formed so that a bias force is applied to the motor contacts urging the motor contacts to the retracted position.

3. The system of claim 1, further comprising a sleeve axially slideable relative to a longitudinal axis of the receptacle and having a tapered portion in mechanical contact with at least one of the motor contacts to thereby push the conductor radially outward as the sleeve moves axially.

4. The system of claim 1, wherein the purging system comprises:

a chamber containing the flowable material;

a piston carried in the chamber; and a weight transfer mechanism coupled to the piston that transfers weight of the pumping system to the piston after the pumping system lands in the receptacle, causing the piston to push the flowable material from the chamber.

5. The system of claim 1, further comprising a profiled channel on an outer surface of the pumping system that is registerable with a key on the receptacle inner circumference that orients the pumping system when it is landed within the receptacle so that the motor contacts are aligned with the receptacle contacts.

6. The system of claim 1, further comprising:

a redundant set of receptacle contacts at a location axially spaced from said first mentioned receptacle contacts relative to a longitudinal axis of the receptacle for engagement by a redundant set of motor contacts to supply power to the motor in the event of failure of said first mentioned receptacle contacts to supply power to the motor.

7. The system of claim 1, wherein the purging system comprises:

a reservoir containing the flowable material;

a piston selectively moveable in the reservoir;

an elongated piston rod extending from the piston;

a fluid flow path from the reservoir having an exit directed towards the receptacle contacts;

a plunger on the end of the piston rod opposite the piston that lands in the receptacle, the weight of the pumping system causing the pumping system and the reservoir to move downward relative to the piston, pushing the flowable material from the reservoir; and a pressure equalizing, conduit in fluid communication with the flowable material in the reservoir and an exterior of the pumping system to equalize pressure in the reservoir with wellbore pressure.

8. The system of claim 1, wherein the flowable material comprises fluids, each having a different density.

9. The system of claim 8, wherein at least one of the fluids is a cleaning agent and the other fluid is a dielectric fluid.

10. The system of claim 1, further comprising:

a seal member that engages and seals a bore of the receptacle below the receptacle contacts when the pumping system lands in the receptacle.

11. A wellbore production system for disposition in a wellbore comprising:

a receptacle for connection to a string of tubing in the wellbore;

electrical receptacle contacts on the inner circumference of the receptacle that are adapted to be in electrical communication with an electrical source;

a pumping system having a pump with fluid inlets and an outlet in fluid communication with the opening of the wellbore, a pump motor mechanically coupled to the pump, and motor contacts in electrical communication with the pump motor and that extend from a retracted position into contact with the receptacle contacts wherein in response to the landing of the pumping system in the receptacle;

a fluid reservoir coupled with the pumping system for containing a non-conductive purging fluid; and a fluid motivation source that is in cooperation with the fluid reservoir, so that when the pumping system engages the receptacle, the non-conductive purging fluid is discharged from the reservoir to between the motor contacts and the receptacle contacts.

12. The wellbore production system of claim 11, wherein the purging system comprises:

a chamber containing the flowable material;

a piston carried in the chamber; and a weight transfer mechanism coupled to the piston that transfers weight of the pumping system to the piston after the pumping system lands in the receptacle, causing the piston to push the flowable material from the chamber.

13. The wellbore production system of claim 11, further comprising a solvent in the reservoir having a density less than the purging fluid so that the solvent is stratified above the purging fluid in the reservoir, and wherein a discharge line is connected to the reservoir so that the solvent is discharged from the reservoir before the purging fluid.

14. The wellbore production system of claim 11, wherein the fluid motivation source comprises a piston selectively movable relative to the reservoir in response to the pumping system landing in the receptacle.

15. The wellbore production system of claim 11, wherein the fluid motivation source comprises a pressurized compressible fluid disposed within the reservoir.

16. The system of claim 11, further comprising:

a seal member that engages and seals a bore of the receptacle below the receptacle contacts when the pumping system lands in the receptacle.

17. The system of claim 11, further comprising:

a redundant set of receptacle contacts at a location axially spaced from said first mentioned receptacle, contacts relative to a longitudinal axis of the receptacle for engagement by redundant set of motor contacts to supply power to the motor in the event of failure of said first mentioned receptacle contacts to supply power to the motor.

18. A method of producing fluids from a hydrocarbon producing wellbore comprising:

providing electrical receptacle contacts on an inner surface of a tubular;

disposing the tubular within the wellbore;

providing a pumping system having a pump, a pump motor, motor contacts in electrical communication with the pump motor, a fluid reservoir, and fluid in the reservoir;

disposing the pumping system into the tubular, discharging the fluid from the reservoir into a space between the receptacle contacts and the motor contacts;

providing redundant electrical receptacle contacts within the tubular at a location in the tubular axially spaced from said first mentioned receptacle contacts;

providing redundant electrical motor contacts within the tubular at a on location axially spaced from said first mentioned motor contacts;

engaging the redundant electrical motor contacts with the redundant electrical receptacle contacts when the first mentioned motor contacts engage the first mentioned receptacle contacts; and supplying power to the redundant electrical receptacle contacts to operate the motor in the event the engagement of the first mentioned motor contacts with the first mentioned receptacle contacts fails to power the motor.

19. The method of claim 18, further comprising:

providing a piston within the reservoir; and wherein discharging the fluid from the reservoir comprises applying weight of the pumping system to the piston when the pumping system is disposed in the tubular, causing relative movement between the piston and the reservoir to discharge the fluid.

20. The method of claim 18, further comprising communicating hydrostatic fluid pressure of fluid in the wellbore to the fluid in the reservoir.

21. The method of claim 18, wherein:

the fluid in the reservoir comprises a liquid;

providing the pumping system comprises charging the reservoir with a gas under pressure; and discharging the fluid comprises using the pressure of the gas to discharge the liquid.

22. The method of claim 18, wherein:

the fluid in the reservoir comprises a blocking fluid and a solvent fluid, the blocking fluid having a different density than the solvent fluid so that the fluid having the lower density stratifies above the fluid having the higher density; and the method further comprises discharging substantially all of the solvent before the blocking fluid.

23. The method of claim 18, wherein disposing the pumping system into the tubular seals a bore of the tubular below the receptacle contacts.

24. The method of claim 18, further comprising when the pumping system is being disposed within the tubular, extending the motor contacts outward from a retracted position into engagement with the receptacle contacts.

* * * * *

UNITED STATES PATENT AND TRADEMARK OFFICE

CERTIFICATE OF CORRECTION

PATENT NO. : 8,397,822 B2
APPLICATION NO. : 12/692342
DATED : March 19, 2013
INVENTOR(S) : Steven K. Tetzlaff et al.

It is certified that error appears in the above-identified patent and that said Letters Patent is hereby corrected as shown below:

In the Specification:

Column 3, line 8, delete “includes” and insert -- include --
Column 3, line 20, insert -- bore -- before “61”
Column 3, line 35, delete “is” after “76”
Column 4, line 47, delete “fowled” and insert -- formed --
Column 8, line 53, delete “fowled” and insert -- formed --

In the Claims:

Claim 7, Column 11, line 39, delete the “,” after “equalizing”

Signed and Sealed this
Seventeenth Day of September, 2013

Teresa Stanek Rea
*Deputy Director of the United States Patent andTrademark Office*